United States Patent [19]

Shore

[11] 4,110,923

[45] Sep. 5, 1978

[54] PRESENTATION-FRAME AND BACKING UNITS PAD

[76] Inventor: Frank Shore, 26 Lantern Rd., Hicksville, N.Y. 11801

[21] Appl. No.: 352,588

[22] Filed: Apr. 19, 1973

[51] Int. Cl.[2] ..... G09F 1/12

[52] U.S. Cl. ..... 40/152; 40/158 R

[58] Field of Search ..... 40/158, 159, 158 B, 40/122, 152

[56] References Cited

U.S. PATENT DOCUMENTS

| | | | |
|---|---|---|---|
| 630,215 | 8/1899 | Gross | 40/159 |
| 833,109 | 10/1906 | Averitt | 40/159 |
| 1,249,328 | 12/1917 | Childs | 40/158 R |
| 1,261,133 | 4/1918 | Kidd | 40/158 |
| 1,593,301 | 7/1926 | Havemeyer | 40/158 |
| 1,867,079 | 7/1932 | Kirsch | 40/122 |
| 2,259,272 | 10/1941 | Sholkin | 40/152 X |
| 2,755,576 | 7/1956 | Golden | 40/125 A X |
| 3,217,438 | 11/1965 | Hathaway | 40/159 |
| 3,534,489 | 10/1970 | Diambra et al. | 40/122 |

*Primary Examiner*—Louis G. Mancene
*Assistant Examiner*—Wenceslao J. Contreras

[57] ABSTRACT

In a preferred embodiment, there is provided a pad in the nature of a tablet form of a plurality of stacked sheets interconnected along one edge thereof in a manner such that a plurality of the consecutive sheets may be simultaneously torn neatly away from the remainder of the pad, with the torn-away portion remaining joined as a unit, each unit comprising a top mat or presentation-frame sheet for in effect framing a picture within a through-passage window with a lower sheet of the unit being a backing sheet, and preferably there being an intermediate sheet having also a window of reduced dimensions of the the nature that the upper face of the second, intermediate sheet is viewable through the upper sheet's window as a margin, and the backing sheet's upper face being viewable through the window of the intermediate sheet, normally in such an arrangement the second sheet's upper face being a different contrasting color to that of the first, upper sheet's upper face, and also preferably either or both the top sheet and the intermediate sheet along its or their respective inner border of the window(s) including an edge margin, each respectively, running parallel to the respective window defined by a partial severence-slot in the respective upper face such that the margin may be bent downwardly slightly or alternatively totally beneath the lower respective face of the adjoining sheet or alternatively totally easily torn loose, a major improvement here being a preferred totally through-severence at each corner of the linear margin where one edge meets another of the window inner margin with the total severence being transverse of the margin strip at the apex of the acute angle enabling the easy bending downwardly of the strip which otherwise would be bound at the corners, it being also possible to color the turned-under strip before flipping it back upwardly pivotally.

3 Claims, 5 Drawing Figures

PRESENTATION-FRAME AND BACKING UNITS PAD

Broadly the invention relates to framing-presentation sheets and backing sheet with or with overlay effect, for picture mounting.

BACKGROUND TO THE INVENTION

Prior to the present invention, the present inventor made available to the public and patented inlay and overlay border picture mats of the nature presented in U.S. Pat. No. 3,382,595 which patent disclosure is hereby incorporated in its entirety herein, of which the present inventor is the patentee thereof, and similarly the present inventor made available to the public and patented pad-bound presentation mats or sheets of the nature presented in U.S. Pat. No. 3,295,674 which patent disclosure is hereby incorporated in its entirety herein, of which the present inventor also is the patentee thereof. There does not appear to be other relevant art pertaining directly to or having a direct bearing on the present invention.

However, it should be noted that in the present-day economy it is critical in most businesses to make use of every possible convenience which will save time and effort in serving the customer if a business is to survive much less if it is to thrive, the cost of labor being prohibitive and the necessity for greater production and greater earning power thereby while maintaining prices and charges to the buying public at a reasonably low economy value which can be afforded by the average public in this day of the shrinking value of the dollar. Accordingly, piece-by-piece work and laborsome time-consuming procedures cannot be afforded in today's business nor tolerated.

SUMMARY OF THE INVENTION

Accordingly, the present invention includes as a principal object the meeting and/or at least partially overcoming or avoiding of problems and difficulties of the nature discussed above.

In particular, another object is to achieve both simplicity and efficiency in the art of border-framing picture, while retaining the fleibility of choice of design and appearance, all together with the holding of costs and charges and prices to a minimum.

Another object is to obtain a short-cut in the normally several step procedure of placing top border-sheet mat and backing board sheet with or without intermediate additional border sheet as an underlay, together, aligning the same while mounting the picture thereon, together with the possibility of modifying the inner border(s) of the top and/or the intermediate border-sheet mat(s) while still avoiding the multiplicity of steps normally necessary, this being achieved by the structured device of the present invention.

Other objects become apparent from the preceding and following disclosure.

One or more objects of the present invention are obtained by the invention as defined herein.

Broadly the invention includes a pad which is composed of a plurality of separate units joined along one edge in a tablet form, one sheet-like element stacked on top of the other, each unit being a combination of two or more sheet-like elements including at least a presentation-mat border-frame sheet having attached along one edge a backing sheet, the unit being such that a person may easily tear the upper-most unit of the tablet separately from the remaining lower portion of the tablet pad and concurrently retain the upper border-frame sheet in the attached state to the backing sheet so that merely one edge may be merely flipped-up of the border-frame sheet pivotably pivoting at the attached edge where attached to the underlying backing sheet, and the picture inserted with the upper sheet already perfectly aligned by virtue of the interconnected edge, thereby retaining the alignment and merely requiring that the border-frame sheet be lowered onto the inserted picture and secured in the lowered position by securing the border-frame sheet to the backing sheet or other equivalent such as then placing the combination unit into an additional framing element of some nature as desired and/or of a conventional type. In a preferred embodiment of the invention, there is also included between the top border-frame sheet and the backing sheet of each unit an intermediate border-framing sheet having a window of preferably lesser size and preferably with evenly aligned windows one central of the other, such that the top of the intermediate sheet is visible through the window of the upper top border-frame sheet which preferably has a window of greater area than that of the intermediately located border-frame sheet, with the window of the intermediately located border-framing sheet being the inner border framing the inserted picture, the three sheer-like elements all being preferably joined along preferably common edges as a unit which unit is separately tearable from the remaining lower stacked joined units of the pad. Each pad includes means for joining the individual sheet-like elements and for joining the stacked plurality of units such as a preferably transparent or translucent edge-joining material or an at least inconspicuous or easily removable material of conventional type which provides a neat appearance as in conventional or other desired tablets or joining mechanisms. Also in a preferred embodiment the inner border of the window of the upper border-frame sheet and/or of the intermediately located border-framing sheet includes a marginal border strip which is defined by a partial severence through the thickness of the respective sheet element and at the ends of each linear margin where one linear edge of the window meets another linear edge of the window, at the apex of the angle thereby formed there is a total-severence slit through the entire thickness of the respective sheet element with the slit extending from the acute angle apex transversely of the margin strips meeting at the corner of the window, such that with ease the strip may be turned downwardly to give an unusual border effect with the turned-down strip being still visible from above but such that if the strip is not bent downwardly the severence is not readily visible. Also the strip portion may be turned completely underward to a position underneath the portion to which it is pivotably anchored and in the underneath position colored or painted or dyed or the like by any appropriate means or method, such as with pencil, ink, crayon, paint, or the like, and then turned again upwardly to its initial position so that it presents the appearance of being an overlay of the top sheet element over a lower sheet element when in fact the inner margin strip has merely been colored to a different color from that of the main portion of the upper face of the sheet element. By turning the margin strip underneath to color, ink or dye it, there is prevented any possibility of getting the coloring media onto the upper face of the remaining portion of the sheet during the process of coloring the turned-down and under strip, and yet the turned-under strip is easily returned to the initial position as a part of the upper face. This is true independent of whether we are speaking of the top sheet of a unit and/or of an intermediate windowed sheet. It is also possible that the strip within the border of the window may be turned downwardly and easily completely torn loose, in order to enlarge the window of the upper sheet and/or of the intermediate sheet(s) as the case may be as desired for a particular situation. It is contemplated that the upper sheet normally will be of a different color or texture than the color of the upper face of the inner (intermediate) sheet such that there is a contrast between the outer border seen of the upper sheet and the inner border either of the strip and/or of the upper face of the intermediate sheet, but such is not essential. Even when the intermediate sheet is of the same color, there is achieved an unusual framing appearance upon the viewing of both an inner and outer framing border.

THE FIGURES

DETAILED DESCRIPTION OF THE INVENTION

Figure 1:
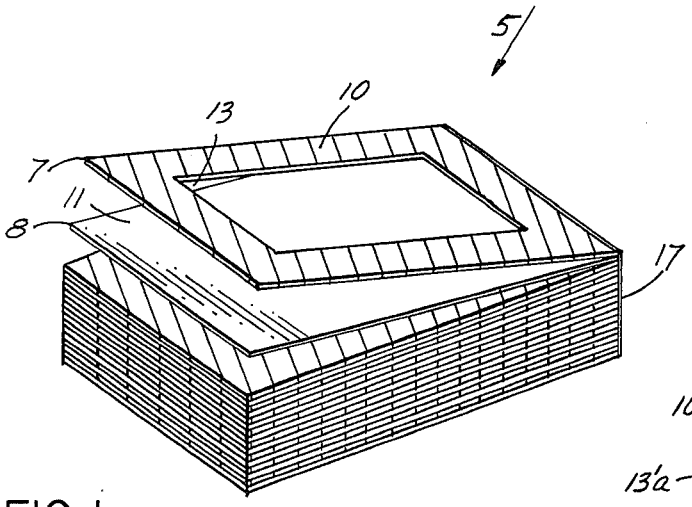
FIG. 1 illustrates a perspective view of a typical pad of the present invention.
Figure 2:
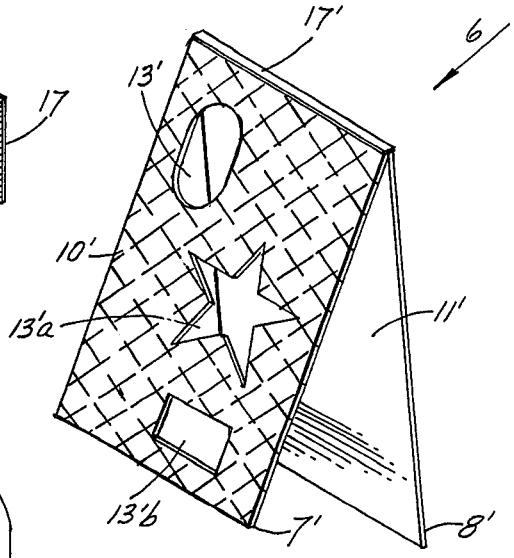
FIG. 2 illustrates a perspective view of an alternative unit of the pad after having been torn from the upper portion of the pad.
Figure 3:
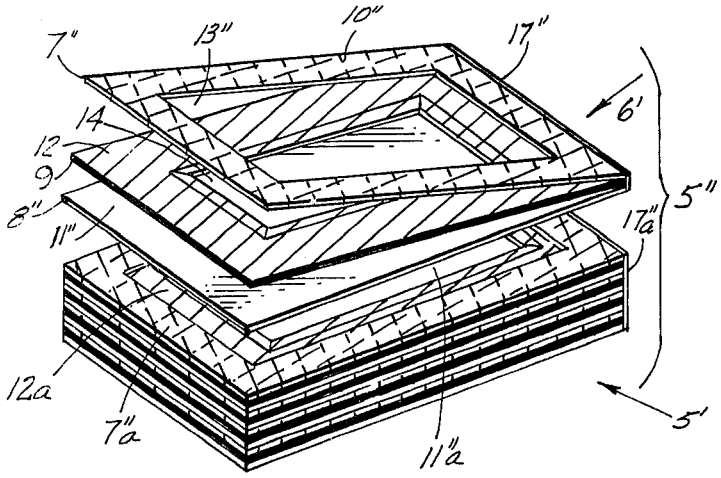
FIG. 3 illustrates in exploded perspective view a still other alternate embodiment having an intermediate framing border sheet also, illustrating in an exploded state a single unit already separated from the remaining lower units of the pad.
Figure 4A:
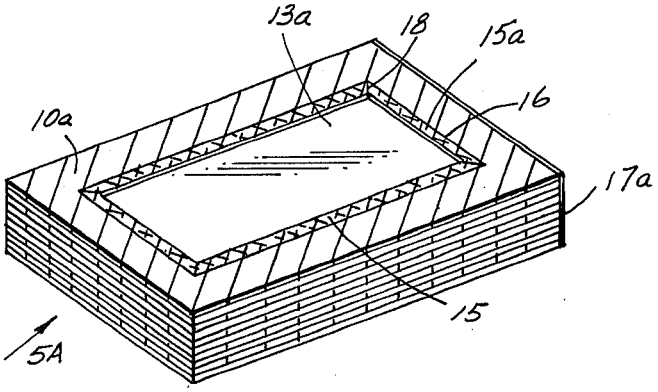
FIG. 4A illustrates in perspective view an embodiment such as that of FIG. 1 except additionally having a window inner periphery border strip defined by a partial severence through the upper surface's thickness and a total severence at each joining corner.

With reference to the embodiments of FIGS. 1, 2, 3, 4A, and 4B, the embodiment of FIG. 1 illustrates a pad 5, while the embodiment of FIG. 2 illustrates a single unit as it would appear after having been torn from a pad, while FIG. 3 illustrates an alternate embodiment showing a single unit 6' after it has been torn from the remainder of the pad 5', the unit 6' and the remainder of the pad 5' making-up jointly the overall pad 5''. The embodiment of FIG. 4A illustrates a pad 5A more or less analagous to that of FIG. 1 embodiment, except additionally having along the border of the upper sheet's window a border strip 15 and 15*a* typically, the FIG. 3 embodiment's intermediate border-frame sheet also having — in the illustrated embodiment (not required however) — a window border strip also of the type discussed above. The corresponding stips 15(side strips) and 15*a*(end strips) are similarly identified in the FIG. 4B but in the illustrated turned downwardly and slightly underward states.

Figure 4B:
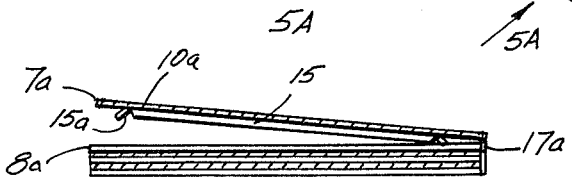
FIG. 4B illustrates a side view of the pad of FIG. 4A with the top sheet pivoted slightly upwardly and the border strips turned downwardly and underwardly in order to illustrate the nature of the window strip.

The figure 1 embodiment in particular illustrates an upper sheet 7 which is a presentation-mat sheet and the backing sheet 8 while FIG. 2 illustrates an analagous unit in a detached state from the remaining joined units of the pad, illustrating the upper border presentation-mat sheet 7' and the lower second backing sheet 8', the FIG. 3 illustrating the upper sheet 7'' and the backing sheet 8'' and an intermediate sheet over which the sheet 7'' overlies, the intermediate sheet 9 being also attached marginally as a part of the unit. Each of FIGS. 4A and 4B illustrate a common embodiment similar to that of FIG. 1, having an upper sheet 7*a* and a backing sheet 8*a*.

The upper face of the FIG. 1 embodiment is illustrated as typically being green as a contrast in color to the white upper face of the backing sheet a part of which backing sheet upper face may or may not optionally be left visible through the window when the picture is mounted on the backing sheet visibly through the window, the white upper face 11 of the backing sheet being normally covered by the picture however. In FIG. 2, there is illustrated an upper sheet face 10' of orange while the upper face of the backing sheet 8' is white upper face 11'. It is noted that the color of the backing face is not material unless it is also contemplated, as within the scope of the invention, that the backing sheet may also serve to give an overlay effect, i.e. by mounting a picture which does not extend completely across the window of the upper sheet and/or the intermediate sheet. In the FIG. 3 embodiment, the upper framing sheet is typically also represented as upper face 10'' as being orange, while the upper face of the intermediate sheet is represented as being green upper face 12, and the upper face 11'' of the backing sheet is illustrated as white. It is to be understood that the color of the upper face of the backing sheet of any pad units may be of a different color than white optionally. It is also possible that the upper sheet of consecutively stacked units per pad be of the same color preferably for cost-control, but optionally the consecutively stacked units may differ in the color of the upper face of the upper sheet and/or of the intermediate sheet and/or of the backing sheet, per pad. In the FIG. 4A embodiment, the upper face of the upper sheet is illustrated as green upper face 10*a* with backing sheet upper white face 11*a*, while the upper sheet's border within the window has been colored orange upper border face 19.

In the various embodiments, as in the FIG. 1 embodiment, there is an attaching coating or fabric 17 extending uprightly along the aligned edges of the sheets in a stacked state, adjoin- the sheet to one-another in a manner represented in each of FIGS. 2 and 3 in which each of the upper-most unit may be easily torn loose from the remaining lower attached units which remain in tact as well as the sheets of the removed unit remaining in tact therey holding the sheets in the preestablished alignment with one-another as well as making it extremely easy to merely pivot-up the upper one or more sheets in order to complete the insertion and mounting of the picture to be mounted conventionally. In the FIG. 1, the attaching marginal strip is illustrated as 17, while in FIG. 2 it is illustrated as 17', while in FIG. 3 it is illustrated as 17'', while in FIGS. 4A and 4B it is indicated by 17*a*.

It is to be understood that there are other possible variations of the present invention such as illustrated in the FIG. 3 embodiment in which the intermediate sheet has a marginal border strip which may optionally turned down or not in the same manner as illustrated for 4A and 4B.

Similarly it is within the scope of the invention to make other variations, modifications, and substitution of equivalents to the extent as would be apparent to a person of ordinary skill, including for example the total removal of a window border strip from one sheet and substitution therefor the detached border strip of another sheet without the necessity of having to dye or color the inner border, noting that the partial severence discussed above considered together with the total corner transverse severence adds a special utility to the respective units of the present pads of stacked joined units of the present invention. However, a particular advantage of the partial severence and transverse total severence is the ease with which it may be turned under and while the strip-containing sheet itself is flipped backwardly providing ready access thereto to the turned-back strips which may be easily colored or dyed or the like, it being immaterial if fast work gets coloring of the adjacent back face of the turned-back strips which after coloring are merely turned or returned to the initial planar state with the sheets upper face but now with the colored border. Windows 13, 13*a*-'—13*c*',13'', 13*a* 13 may vary in number and shape.

It may be seen therefore that by the use of the present invention, a great deal of time and effort may be saved with the concurrent advantages of having flexibility of designs and choices of design and variations thereof as embodied in the structure as made available by the present invention.

I claim:

1. A picture frame and backing tablet device comprising in combination: stacked tablet detachable sheet structures including (a) a first plurality of first sheet-like substantially opaque elements each having first upper and lower planar surfaces with a first circumscribing periphery, and (b) a second plurality of second sheet-like substantially opaque elements each having second upper and lower substantially planar faces with a second circumscribing outer periphery, at least one of said second sheet-like elements being disposed between consecutive ones of said first sheet-like elements; a tablet edge-connecting strip means detachably interconnecting substantially aligned portions of stacked said sheet structures at one side edge of said first and second circumscribing peripheries such that there is formed a tablet pad having stacked detachable units edge-connected to one-another of the units serially arranged from a top to a bottom of the tablet pad, each detachable tablet unit including the inter-connected first and second peripheries; each first sheet element of said plurality having at least one through-passage being defined by passage-circumscribing walls of the first periphery of the first sheet-like element, the first through-passage being of sufficient cross-sectional area that the passage-circumscribing walls form a first-element picture frame for each unit, said second sheet-like element's upper face being of sufficient area for said second sheet-like element to serve as a backing element for a picture to be mounted on said upper face for viewing through said through-passage for each detachable unit; each said first upper face including an inner circumscribing edge of its through-passage, a severence slot through a partial thickness of the thickness of the first sheet-like element defining an edge-margin strip, each of the first sheet-like element's through-passage defined by a plurality of linear inner edges of said edge-margin strip with adjacent consecutive linear edges defining an acute angle, and extending from an apex of the acute angle there being a total severence through substantially the entire thickness of the first sheet-like element transversely across the respective edge-margin strip such that each edge-margin strip may be pivotably turned downwardly and optionally under the first sheet-like lower face and such that the edge-margin strip is easily totally separable by tearing if desired.

2. A picture frame and backing device of claim 1, including in each said first sheet-like element a plurality of said through-passages.

3. A picture frame and backing device comprising in combination: a first plurality of first sheet-like elements each having first upper and lower substantially planar faces; a second plurality of second sheet-like elements each having second upper and lower substantially planar faces with a second circumscribing outer periphery, at least one of said second sheet-like elements being disposed between consecutive ones of said first sheet-like elements; an edge-connecting strip means interconnecting substantially aligned portions of said first and second peripheries thereby forming a pad of said first and second pluralities; each first sheet-like element of said first plurality having at least one through-passage extending between said first upper and lower faces, the through-passage being defined by passage-circumscribing walls of the first sheet-like element, the through-passage being of sufficient cross-sectional area that the circumscribing walls form a first-element picture frame, said second sheet-like element to serve as a backing element for a picture to be mounted on said second upper face for viewing through said through-passage; and a third plurality of sheet-like elements having third upper and lower faces with a third circumscribing outer periphery, at least one of said third sheet-like elements being disposed between a first lower face of a sheet-like element and a second upper face of a second sheet-like element having at least one second through-passage extending between said third upper and lower faces defined by passage-circumscribing walls of the second sheet-like element thereof, said second through-passage being at least partially aligned with said first through-passage; and cross-sectional area of said through-passage of each third plurality sheet-like element exceeds the cross-sectional area of a substantially aligned first sheet-like element's through-passage; and at least a portion of an outer circumscribing edge of each third plurality sheet-like element is joined to said interconnecting means; and each third upper face includes adjacent to and spaced from an inner circumscribing edge of its through-passage a severence slot through a partial thickness of the thickness of the third plurality sheet-like element defining an edge-margin strip, each of the third plurality sheet-like element's through-passage having a cross-section perpherally defined by a plurality of linear inner edges defining an acute angle, and extending from an apex of the acute angle there being a total severence through substantially the entire thickness of the third plurality sheet-like element transversely across the respective edge-margin strip such that each edge-margin strip may be pivotably turned downwardly and optionally under the third plurality sheet-like element's lower face and such that the edge-margin strip is easily totally separable by tearing if desired.

* * * * *